US005573276A

United States Patent [19]

Nomura et al.

[11] Patent Number: 5,573,276

[45] Date of Patent: Nov. 12, 1996

[54] GREETING CARD HOLDER APPARATUS AND METHOD

[75] Inventors: Lisa M. Nomura, 137 W. Central Ave. #D, Monrovia, Calif. 91016; Ron W. Schneberger, Tigard, Oreg.

[73] Assignees: Lisa M. Nomura, Los Angeles; Rundel Products, Inc., Portland, Oreg.; by said Ron W. Schneberger, a part interest

[21] Appl. No.: 255,093

[22] Filed: Jun. 7, 1994

[51] Int. Cl.[6] ..... B42D 3/00

[52] U.S. Cl. ..... 281/48; 281/45

[58] Field of Search ..... 281/48, 15.1, 21.1, 281/36, 37, 29; 402/8

[56] References Cited

U.S. PATENT DOCUMENTS

| | | | |
|---|---|---|---|
| 71,703 | 12/1867 | Clark | 281/48 |
| 234,987 | 11/1880 | King | 281/48 |
| 2,336,214 | 12/1943 | Bantels | 281/48 |
| 3,170,260 | 2/1965 | Parker . | |
| 5,096,227 | 3/1992 | Pinkerton . | |
| 5,236,226 | 8/1993 | Sheffield . | |
| 5,265,914 | 11/1993 | Russell | 402/8 |

*Primary Examiner*—Willmon Fridie, Jr.

*Attorney, Agent, or Firm*—Flehr, Hohbach, Test, Albritton & Herbert

[57] ABSTRACT

A greeting card holding and displaying apparatus (10) including a folder (11) having a front panel (12), a rear panel (13), and a central spine (14) foldably joining the front panel (12) to the rear panel (13). An inner lining (15) mounted to interior surfaces (21, 22) of the folder (11) is included formed from a single continuous piece of material having a front section (16), a rear section (17) and central section (20) of the foldably joining the front section (16) to the rear section (17) in a spaced apart manner. A plurality of side-by-side strands (25) each continuously extending from a backside surface (26) of the central section (20) over a central section upper edge (23), across an opposite frontside surface (27) of the central section (20) and over a central section lower edge (24) back to the backside surface (26). A method of forming the apparatus (10) is also provided.

5 Claims, 2 Drawing Sheets

GREETING CARD HOLDER APPARATUS AND METHOD

TECHNICAL FIELD

The present invention relates, generally, to greeting cards, and, more particularly, relates to methods and devices for holding greeting cards.

BACKGROUND ART

During the various annual holidays and special occasions, greeting cards are often the preferred form of salutation. Generally, these cards are proudly displayed in a tented manner atop tables and counters, or are affixed to walls or the like. Other more inventive techniques for displaying greeting cards, however, are well known in the art which provide a plurality of spaced-apart, side-by-side elastic strings or strands formed to seat in the fold of a card so that the card can be suspended or supported therefrom. Typical of these patented card and sheet paper holders may be found in U.S. Pat. Nos. 104,415; 104,863; 158,839; 308,295; 936,223; 3,789,526; 4,840,407; and 4,852,280.

While these devices adequately retain the cards or paper sheets therein, several problems are inherent in many of these devices. Most of these card holding devices are laborious and time consuming to manufacture since special care is required to mount the side-by-side elastic strands to a holding device such as a folder. Typically, a central bar, core or post member must be provided to support and secure the series of strands in a side-by-side relation, which is then mounted to a spine of the folder. As a result, manufacture is more complex and costly.

Moreover, the series of elastic strands are usually resilient to retain the strands neatly against the bar or post member, or the spine of the folder. These resilient strands, however, tend to stretch after repeated use which ultimately causes a reduction of resiliency in each strand. Hence, the strands start to sag which is aesthetically unappealing, often resulting in premature discardation of the card holder.

DISCLOSURE OF INVENTION

Accordingly, it is an object of the present invention to provide a holder apparatus and method for displaying a plurality of greeting cards in a decorative and functional manner.

Another object of the present invention is to provide a greeting card holder apparatus and method which is non-complex and relatively simple to manufacture.

Still another object of the present invention is to provide a greeting card holder apparatus and method with which the cards can be organized easily and conveniently.

Yet another object of the present invention is to provide a greeting card holder apparatus and method which is capable of accommodating different sized greeting cards.

Another object of the present invention is to provide a greeting card holder apparatus and method which retains its aesthetic and displaying appeal for longer periods of time.

It is a further object of the present invention to provide a greeting card holder apparatus and method that is durable, compact, easy to maintain, has a minimum number of components, and is easy to use by unskilled personnel.

In accordance with the foregoing objects, the present invention provides a greeting card holding and displaying apparatus including a folder with a front panel, a rear panel, and a central spine foldably joining the front panel portion to the rear panel in a spaced apart manner along respective height dimensions thereof. An inner lining is included formed from a single continuous piece of material having a front section mounted to an interior surface of the front panel and extending substantially along the front panel height dimension proximate the spine. Further, the lining includes a rear section mounted to an interior surface of the rear panel and extending substantially along the rear panel height dimension proximate the spine. A central section of the lining foldably joins the front section to the rear section in a spaced apart manner which defines an upper edge and an opposing lower edge. A plurality of side-by-side strands each continuously extending from a backside surface of the central section over the upper edge, across an opposite frontside surface of the central section and over the lower edge back to the backside surface.

A method of the present invention for forming the greeting card holding and displaying apparatus, briefly, comprises the steps of: sliding a plurality of strands formed of continuous loops around the lining material in a side-by-side manner until each loop encircles the central section of the lining material from the upper edge to the lower edge, each loop being of sufficient length to be supported on the central section in a relatively taut manner; mounting the front section to an interior surface of the front panel to cover at least a portion thereof such that the front section extends substantially along the front panel height dimension proximate the spine; and mounting the rear section to an interior surface of the rear panel to cover at least a portion thereof such that the rear section extends substantially along the front panel height dimension proximate the spine.

BRIEF DESCRIPTION OF THE DRAWING

The assembly of the present invention has other objects and features of advantage which will be more readily apparent from the following description of the best mode of carrying out the invention and the appended claims, when taken in conjunction with the accompanying drawing, in which:

BEST MODE OF CARRYING OUT THE INVENTION

Figure 1:
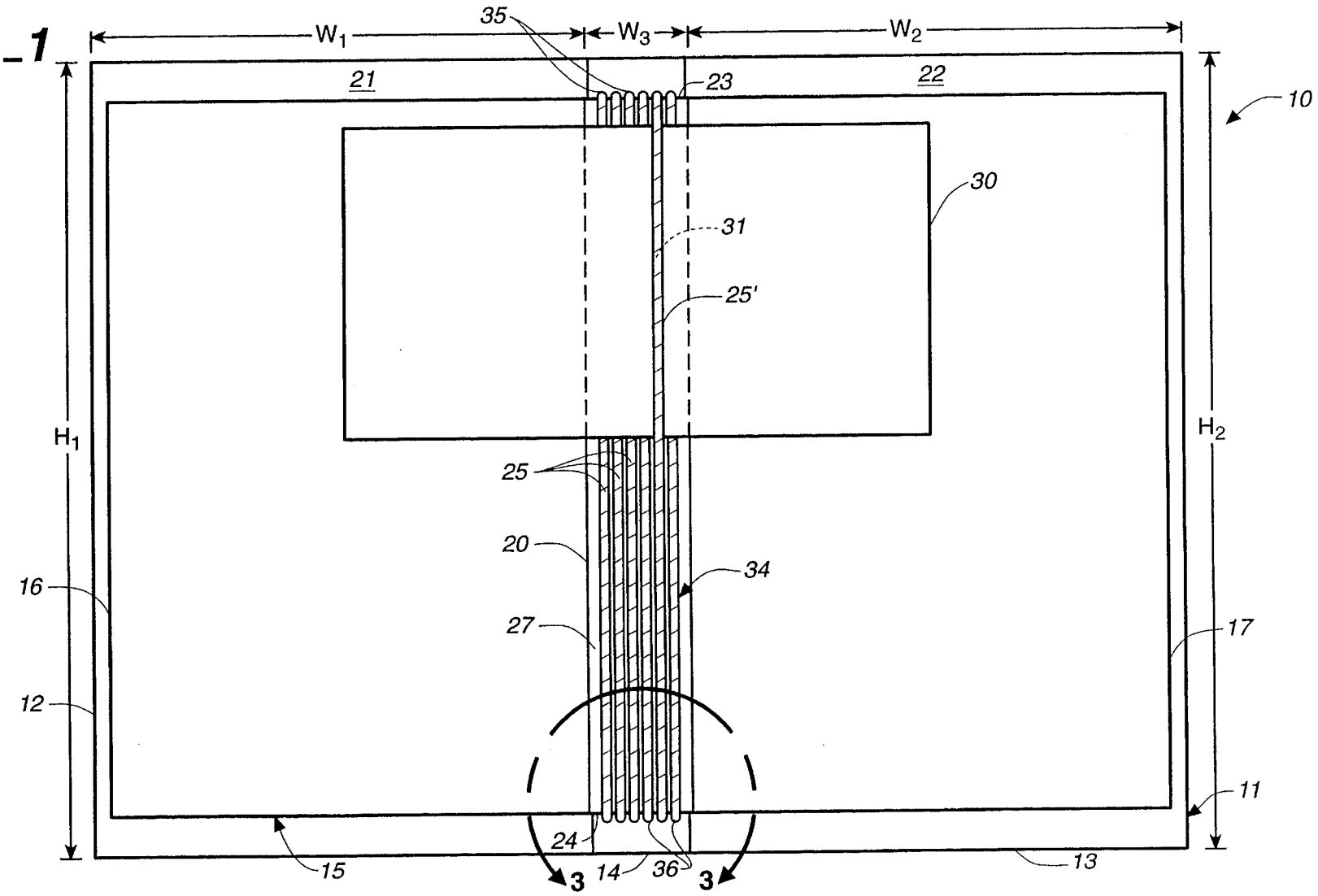
FIG. 1 is a top plan view of a greeting card holding and displaying apparatus constructed in accordance with the present invention and having a greeting card mounted therein.

While the present invention will be described with reference to a specific embodiment, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Figure 2:
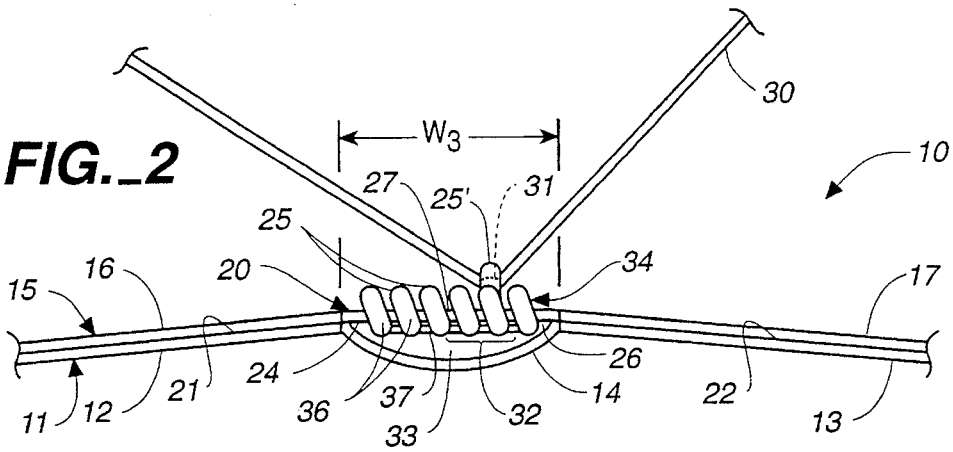
FIG. 2 is a fragmentary, enlarged front elevation view of the greeting card holding and displaying apparatus of FIG. 1.

Attention is now directed to FIG. 1 where a greeting card holding and displaying apparatus, generally designated 10, of the present invention is illustrated. Briefly, card displaying apparatus 10 includes a folder 11 having: a front panel 12 with a height dimension ($H_1$) and a width dimension ($W_1$); a rear panel 13 having a height dimension ($H_2$) and a width dimension ($W_2$); and a central spine 14 foldably joining front panel 12 to rear panel 13 in a spaced apart manner along respective height dimensions ($H_1$), ($H_2$). A single continuous sheet of inner lining material, generally designated 15, includes a front section 16, a rear section 17, and a central section 20 foldably joining front section 16 to rear section 17. The front section 16 and the rear section 17 are mounted to and cover at least a portion of respective interior surfaces 21, 22 of front and rear panels 12, 13, respectively. Further, each of the front and rear section 16, 17 of lining material 15 extend substantially along or in the direction of respective front and rear panel height dimensions ($H_1$), ($H_2$) proximate spine 14. FIGS. 1 and 2 illustrate that central section 20 foldably joins front section 16 to rear section 17 in a spaced apart manner, and forms an upper edge 23 and an opposing lower edge 24 thereof spanning a width dimension ($W_3$) of spine 14. Finally, card displaying apparatus 10 includes a plurality of side-by-side strands or strings, generally designated 25, each mounted to display apparatus 10 by encircling lining sheet 15 in the area of spline 14. Thus, each strand 25 continuously extends from a backside surface 26 of central section 20 over the central section upper edge 23, across a frontside surface 27 (FIGS. 2 and 4) of central section 20, and over lower edge 24 back to central section backside surface 26.

Accordingly, the present invention provides a greeting card holding apparatus which employs the inner lining of the folder to retain and support the plurality of card holding strands. In contrast, the prior art devices above-discussed required additional retaining structure mounted to the spine or the folder upon which the strands were supported. Such arrangements were more difficult to manufacture, as well as increasing overall material and production costs.

Briefly, to mount or support a greeting card 30 to displaying apparatus 10, one edge of the greeting card is slid underneath a chosen strand 25', as illustrated in FIGS. 1 and 2, until a fold line 31 of the card receives or seats strand 25' therein for retainment. Because of the relatively taut disposition of the strand, the fold of greeting card 30 will be retained and supported against the lining central section 20. Further, depending upon the height dimension of the strands, most card sizes can be accommodated even if they are substantially smaller in height than the strand, as viewed in FIG. 1. Several cards may be retained on a single strand, or a whole collection may be supported and retained by the remaining strands.

Figure 4:
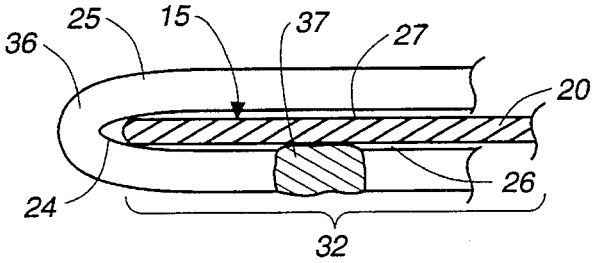
FIG. 4 is a fragmentary side elevation view of a strand taken substantially along the plane of line 4—4 in FIG. 3, and illustrating a bend and sonic weld therein.

In accordance with the present invention, the individual strands 25 preferably fully encircle central section 20 of the inner lining, each of which are supported by the central section in a taut manner. As the individual strands 25 extend over the central section upper edge 23 and lower edge 24, backside portions 32 of the strands, as shown in FIGS. 2 and 4, extend through a crescent shaped pocket 33 formed between the folder central spine 14 and the lining central section 20 where the strands can be anchored to keep them taut. Moreover, in the preferred embodiment, the plurality of strands are provided by a single cord member 34 which continuously encircles or wraps around central section 20 to form the successive, side-by-side loop strands 25. Each individual loop is of a sufficient length to retain the strands tautly to prevent excessive sagging. It will be understood, however, that separate independent loops of sufficient length may be provided without departing from the true nature and spirit of the present invention. Further, each independent strand may not fully encircle central section 20 as long as they employ and extend over both upper edge 23 and lower edge for support, as shown in FIG. 4.

While only six (6) individual loops are provided for illustrative purposes, any number of loops may be provided. It is desirable to decrease the spacing between the loops so that they are more densely situated along the central section as long as they are not overlapping. In the preferred form, approximately twenty-five (25) loops are successively wound around the central section.

Cord member 34 is preferably formed of a thermoplastic material, such as a plastic resin, providing limited flexibility or deflection in directions perpendicular to a longitudinal axis of each strand. The strands only need to deflect a sufficient amount to slide the edge of the greeting card therethrough. More importantly, each strand is relatively inelastic in the longitudinal direction of the strand so that after repeated use, each strand will generally retain its original shape and length. This will assure resistance to sagging, as well as prevent permanent deformation or stretching in the longitudinal direction. One such plastic resin material may be provided by extruded low density polyethylene.

Since this preferable thermoplastic material is relatively longitudinally inelastic and of limited deformation ability, strands 25 are preferably bent at regions proximate upper edge 23 and lower edge 24 (FIGS. 1 and 4) so that the frontside portion of the strand laying across the frontside surface 27 of the central section is substantially parallel therewith. This assures that portions of the individual strands near and in contact with the central section upper and lower edges do not bulge too far outwardly due to the limited flexibility of the strand material. These upper and lower bends 35, 36, respectively, are aligned with the corresponding upper and lower edges 23, 24, respectively, for receipt therein.

Figure 3:
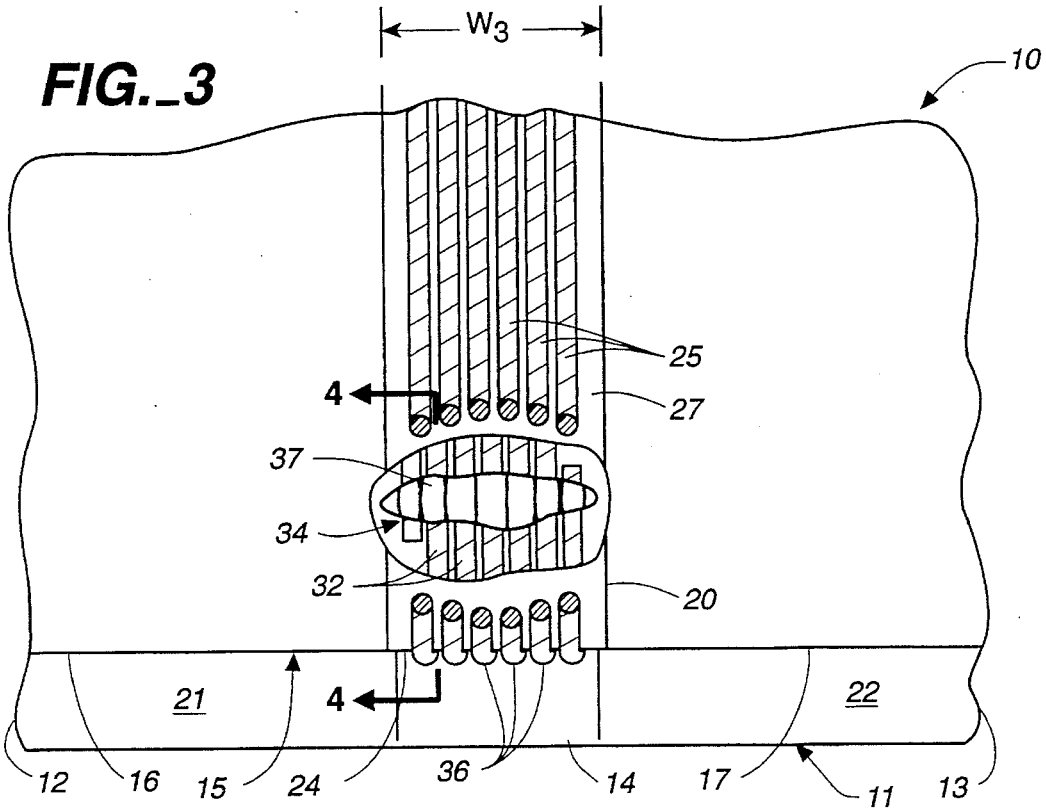
FIG. 3 is an enlarged, fragmentary top plan view, partially broken away, of the greeting card holding and displaying apparatus taken substantially along the line 3—3 in FIG. 1, and illustrating the sonic welds holding the strands together.

FIG. 3 illustrates that the backside portions 32 of strands 25 are secured together for additional support. This also facilitates mounting of the strands to central section 20 since they all can be mounted together as a unit. In the preferred embodiment, the plurality of strands are melted or welded together at a melted portion 37 which is substantially transverse the side-by-side thermoplastic loop strands 25 to form a single unit. Preferably, a first melted portion 37 (FIG. 3) is to be oriented and positioned at backside surface 26 of central section 20 proximate lower edge 24. Similarly, an opposing second melted portion 37 is to be oriented and positioned at backside surface 26 proximate upper edge 23 (not shown, but the reverse of the lower edge portion). These opposed melted portions near the upper and lower central section edges prevent puckering of the strands, and more importantly, substantially prevent tangling and cross-over of the strands at the upper and lower bend portions.

A sonic welding technique, well known in the art, is preferably employed to cause localized melting or welding of the strands transversely thereof. This technique can be performed in bulk whereby individual groups of the plurality of strands can be cut therefrom for each application.

It is further advantageous for inner lining material 15 to be sufficiently rigid to provide support to loop strands 25 to assure tautness. Too flexible of a lining material may cause the central section upper and lower edges to bend due to the forces applied by the strands. Additional support is provide by mounting the lining to the folder interior surfaces 21, 22, which in combination with relatively thick paper or cardboard lining, provides sufficient support.

It will be understood that while front section 16 and rear section 17 preferably cover a substantial whole of the respective interior surfaces 21, 22 of the folder, only a portion of the interior surfaces need be covered to provide the novel attributes of the present invention. As mentioned, however, it is important to support the front and rear sections of the lining along the height dimensions proximate the central spine portion of the folder section so that the central section of the lining spans the width ($W_3$) of the spine (FIG. 2). This may be accomplished by the application of an adhesive between a backside surface of front section 16 and rear section 17 and the opposing front and rear panel interior surfaces 21, 22, respectively. Accordingly, each loop is permitted to slide along upper edge 23 and lower edge 24 without sliding off of from the central section.

In another aspect of the present invention, a method of forming a greeting card holding and displaying apparatus is provided comprising the steps of: providing a folder 11 including front panel 12, rear panel 13, and central spine 14 foldably joining front panel 12 to rear panel 13; and providing a single continuous sheet of inner lining material 15 including front section 16, rear section 17, and central section 20 foldably joining front section 16 to rear section 17. The next step includes sliding a plurality of strands 25 formed of continuous loops around lining material 15 in a side-by-side manner until each loop encircles central section 20 of lining material 15 from upper edge 23 to lower edge 24 thereof. Each loop is of a sufficient length to be supported on central section 20 in a relatively taut manner. The next steps include mounting the front and rear sections 16, 17 of the lining to respective interior surface 21, 22 of front and rear panels 12, 13 to cover at least a portion thereof such that front and rear section 16, 17 extends substantially along their height dimensions ($H_1$), ($H_2$) proximate central spine 14.

Before the sliding step, the plurality of strands may be constructed by forming a series of continuous loops in a side-by-side manner; and melting the successive strands 25 together at melted portions 37 thereof substantially transverse the side-by-side loops to form a single unit. As mentioned above, the preferred melting technique is performed by sonic welding.

To slide the plurality of strands onto the central section of the lining, the lining may be bowed or bent, and then slid through the strands. Upon orienting the melted portions 37 proximate the upper and lower sections backside, and upon aligning the upper and lower bends 35, 36 with the corresponding upper edge 23 and lower edge 24, the bowed lining material may be opened until the strands are tautly supported by central section 20.

What is claimed is:

1. A method of forming a greeting card holding and displaying apparatus comprising the steps of:

providing a folder including a front panel, a rear panel, and a central spine foldably joining said front panel to said rear panel in a spaced apart manner along respective height dimensions of said front panel and said rear panel;

providing a single continuous sheet of inner lining material including a front section, a rear section, and a central section foldably joining said front section to said rear section in a spaced apart manner and defining an upper edge and an opposing lower edge each extending between said front section and said rear section;

forming a series of continuous loops from a plurality of thermoplastic strands in a side-by-side manner;

melting said strands together at a melted portion thereof substantially transverse the side-by-side loops to form a single unit;

sliding said single unit of strands around said lining material in a side-by-side manner until each loop encircles said central section of said lining material from said upper edge to said lower edge, each loop being of sufficient length to be supported on said central section in a relatively taut manner, said sliding step being oriented such that said melted portion is positioned proximate said central section backside surface;

affixing said front section to an interior surface of said front panel to cover at least a portion thereof such that said front section extends substantially along said front panel height dimension proximate said spine; and affixing said rear section to an interior surface of said rear panel to cover at least a portion thereof such that said rear section extends substantially along said front panel height dimension proximate said spine.

2. The method as defined in claim 1 wherein, said melting step is accomplished by sonic welding.

3. The method as defined in claim 2 wherein, said plurality of strands is provided by a single cord member encircling said central section to form said side-by-side loops.

4. The method as defined in claim 2 wherein, said cord member is composed of extruded low density polyethylene.

5. The method as defined in claim 1 wherein, said melting step is accomplished by:

melting said strands together at a first melted portion thereof substantially transverse the side-by-side loops to form a single unit, said mounting step being oriented such that said first melted portion is positioned at the backside surface of said central section proximate said lower edge; and melting said strands together at a second melted portion thereof substantially transverse the side-by-side loops, said mounting step being oriented such that said second melted portion is positioned at the backside surface of said central section proximate said upper edge.

* * * * *